United States Patent [19]

Arai

[11] 4,207,452

[45] Jun. 10, 1980

[54] ACTIVATED GAS GENERATOR

[75] Inventor: Sakae Arai, Yokohama, Japan

[73] Assignee: Tokyo Shibaura Electric Co., Ltd., Kawasaki, Japan

[21] Appl. No.: 897,727

[22] Filed: Apr. 19, 1978

[30] Foreign Application Priority Data

Apr. 25, 1977 [JP] Japan ..... 52-46744

[51] Int. Cl.[2] ..... H05B 9/06

[52] U.S. Cl. ..... 219/10.55 A; 219/10.55 R; 315/39

[58] Field of Search ..... 219/10.55 A, 10.55 R, 219/10.55 D, 10.55 F; 315/39, 111.2; 313/231.3; 333/99 PL; 174/15 R

[56] References Cited

U.S. PATENT DOCUMENTS

| | | | |
|---|---|---|---|
| 3,392,303 | 7/1968 | Wolf et al. | 315/39 X |
| 3,476,968 | 11/1969 | Omura | 315/111.2 X |
| 3,522,476 | 8/1970 | Puschner | 315/39 X |
| 3,535,482 | 10/1970 | Kluck et al. | 219/10.55 R |
| 3,577,207 | 5/1971 | Kirjushin | 219/10.55 A X |
| 3,641,389 | 2/1972 | Leidigh | 315/39 |
| 3,649,868 | 3/1972 | Bensussan | 315/39 |
| 3,906,892 | 9/1975 | Van Cakenberghe | 313/231.3 X |
| 4,049,940 | 9/1977 | Moisan et al. | 313/231.3 X |
| 4,090,055 | 5/1978 | King | 219/10.55 A X |

FOREIGN PATENT DOCUMENTS

| | | |
|---|---|---|
| 42-1974 | 10/1967 | Japan . |
| 50-9545 | 4/1975 | Japan . |
| 51-84580 | 7/1976 | Japan . |

OTHER PUBLICATIONS

Hollahan, J. R., *Techniques and Applications of Plasma Chemistry*, J. Wiley & Sons 1974, pp. 120–121.

*Primary Examiner*—Arthur T. Grimley
*Attorney, Agent, or Firm*—Cushman, Darby & Cushman

[57] ABSTRACT

An activated gas generator which comprises a microwave absorber containing, for example, water and surrounding a dielectric tube concurrently to absorb microwaves leaking along the dielectric tube and also cool it. The dielectric tube is formed in a gas pipe which extends through a microwave irradiation furnace and which is connectable at a raw gas source and at its other end to a reaction chamber and a vacuum pump. The microwave absorber is mounted at least to a portion of the tube adjacent to the reaction chamber and vacuum pump.

15 Claims, 11 Drawing Figures

ACTIVATED GAS GENERATOR

BACKGROUND OF THE INVENTION

This invention relates to an activated gas generator which applies a microwave electric energy to a gas under reduced pressure.

Recently developed is an apparatus which subjects gas under reduced pressure to the discharge by microwave energy having a frequency ranging from 300 MHz to 30 GHz (hereinafter referred to as "microwaves") to activate said gas and applies the activated gas in the etching of a silicon wafer, the incineration of a photoresist, and the improvement of the hydrophilic and adhesive property of the surface of plastics and metals.

FIG. 1 shows the arrangement of the prior art apparatus for activating a gas by microwave energy and treating various substances by the activated gas. Microwave energy produced by a microwave power generator 1 provided with a microwave tube used with, for example, a magnetron is conducted to a waveguide 2. Thereafter, microwave energy is sent forth to a microwave irradiation furnace 6 through an isolator 3, power monitor 4 for detecting reflected electric energy and a tuner for impedance matching unit 5. The irradiation furnace 6 contains a movable short-plunger 7 for impedance matching. A metal tube 8 projects outward from the inner wall of the microwave irradiation furnace 6 in which a magnetic field is created. A gas pipe 9 penetrates the microwave irradiation furnace 6 and metal tube 8. That portion 10 of the gas pipe 9 where a gas is activated by microwave energy is formed of dielectric material. The gas pipe 9 is connected at one end to a raw gas tank 12 through a valve 11 and at the other end to a reaction chamber 13 for treating an object material. A vacuum pump 14 is connected to the reaction chamber 13 to evacuate the gas pipe 9. A gas introduced from the gas tank 12 under reduced pressure is activated in the microwave irradiation furnace 6 by microwave energy produced by a microwave power generator, and then brought into the reaction chamber 13.

With an activated gas generator constructed as described above, most of the microwave energy produced is used to activate a gas introduced. However, part of the microwaves leaks through an interstice between the metal tube 8 and gas pipe 9. To reduce said leakage to, for example, less than 1 mW/cm$^2$, the metal tube 8 was formerly made sufficiently long to seal the glowing portion owing to gas discharge of the gas-activating region of the microwave irradiation furnace 6. Where oxygen plasma was produced by the microwave energy 10.8 KW having a frequency of, for example 2450 the metal tube 8 had to be made longer than 250 mm. Therefore, particularly that portion 10 of the gas pipe 9 which extended from the microwave irradiation furnace 6 down to the reaction chamber 13 was made longer in proportion to the whole length of the metal tube 8. Extension of the gas pipe is undersirable, because particles of activated gas are recombined, more prominently rendering the whole gas unactivated.

While a gas was not exposed to the discharge of microwave energy, said energy obviously did not leak from the metal tube 8. Yet when the gas has been activated by the discharge of microwave energy, then said energy prominently leaked. Particularly, the gas outlet section of the gas pipe 9 which was connected to the vacuum pump 14 was found to indicate a more noticeable leakage of microwave energy than the gas inlet section of the gas pipe 9. It is further knwon that a dielectric material constituting that portion of the gas pipe 9 which was enclosed in the microwave irradiation furnace 6 where gas under reduced pressure was activated by the discharge of microwave energy had sometimes its temperature raised over 300° C.

A dielectric material such as quartz, alumina porcelain more increased in dielectric loss according as its temperature rose. Consequently, the dielectric material itself absorbed a larger amount of microwave energy, resulting in a further increase in said temperature. Elevated temperature of the dielectric material not only gave rise to difficulties in handling a gas-activating apparatus, but also caused the dielectric material itself to be partly etched by some kind of activated gas. Heat indicated by the above-mentioned higher temperature of the dielectric material than 300° C. was transmitted to the reaction chamber 13, causing the whole activated gas generator to be highly heated. Therefore, full consideration had to be given to the heat-resistant property of that portion of the reaction chamber 13 which contacted the dielectric material of the gas pipe 9. Consequently, the gas pipe 9 and reaction chamber 13 had to be integrally constructed of the same material, raising great problems in respect of the handling and production cost of an activated gas generator.

Hitherto, therefore, cooling air was introduced into the microwave irradiation furnace 6 at one end to cool the dielectric tube. Or the gas pipe 9 was cooled by forcefully blowing cooling air to the outside.

With the prior art gas-activating apparatus, therefore, means for preventing the leakage of microwaves was provided separately from means for cooling the dielectric tube which tended to be highly heated. Yet neither of these means provided satisfactorily effective.

SUMMARY OF THE INVENTION

It is accordingly the object of this invention to provide an activated gas generator which is provided with means not only for thermally isolating off from the outside that portion of the gas pipe which is enclosed in the microwave irradiation furnace but also for reducing the leakage of microwaves from that portion of the metal tube which is enclosed in the microwave irradiation furnace.

BRIEF DESCRIPTION OF THE DRAWINGS

There will now be described an activated gas generator embodying this invention by reference to the accompanying drawings in which.

DESCRIPTION OF THE PREFERRED EMBODIMENTS

Figure 2:
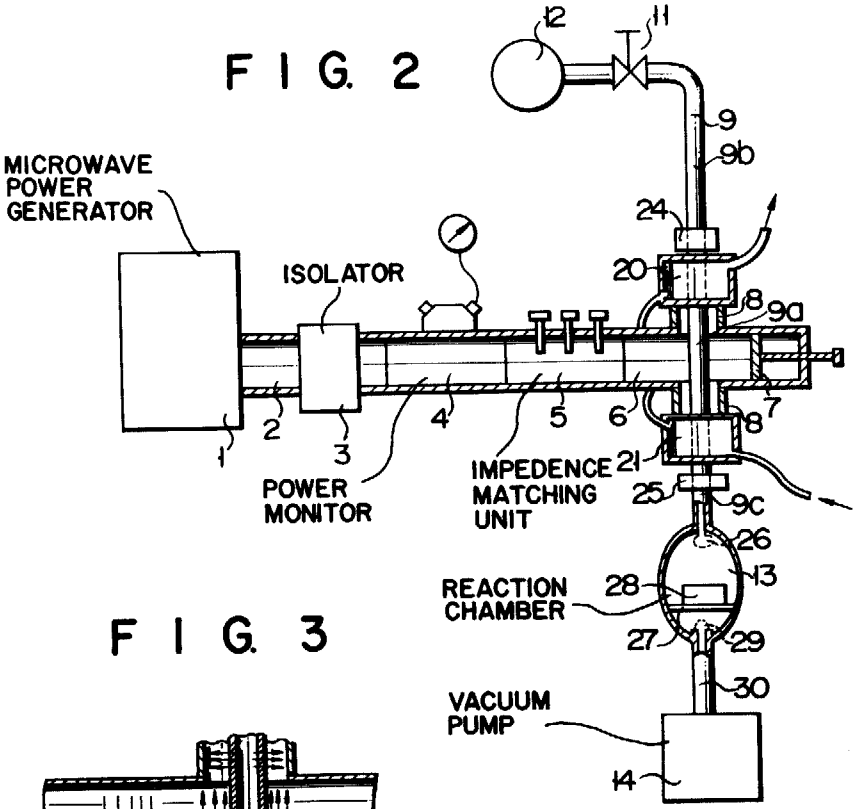
FIG. 2 is a longitudinal sectional view of an activated gas generator according to a first embodiment of this invention.
Figure 1:
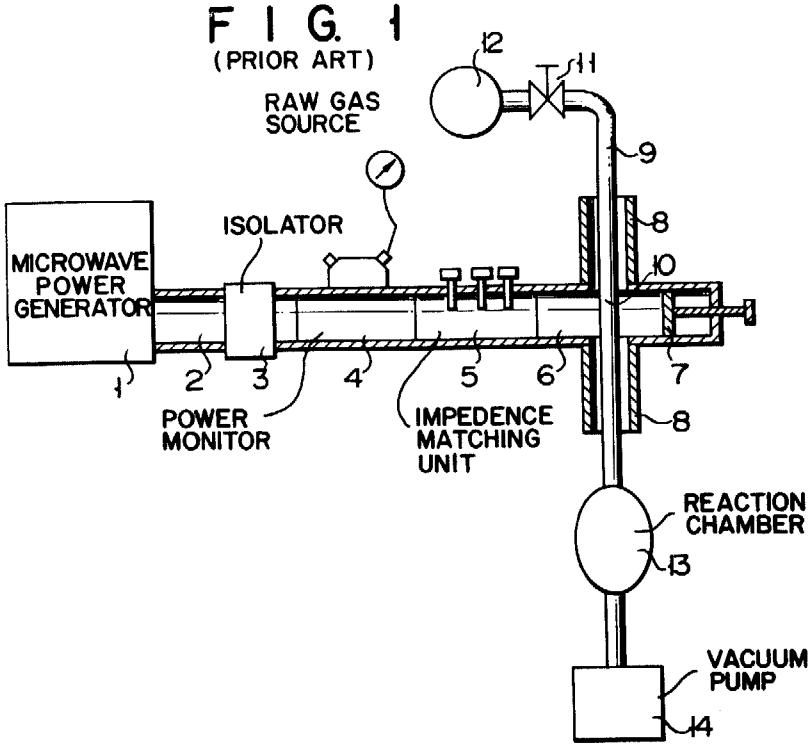
FIG. 1 (PRIOR ART)
FIG. 1 is a longitudinal sectional view of the prior art activated gas generator.

FIG. 2 is a longitudinal sectional view of an activated gas generator according to a first embodiment of this invention combined with an accessory etching unit. Microwave energy sent forth from a microwave power generator 1 are conducted to a microwave irradiation furnace 6 through the same component units as in the prior art activated gas generator of FIG. 1. Microwaves delivered from the microwave power generator 1 provided with a microwave oscillator is conducted to a parallelepiped waveguide in the waveform of $TE_{01}$. Thereafter, the microwaves are carried to a microwave irradiation furnace 6 through an isolator 3, power monitor 4 for detecting reflected electric energy and a tuner for impedance matching unit 5. A movable short plunger 7 is received in the microwave irradiation furnace 6. The movable short plunger 7 is so set as to cause the point of maximum intensity of a microwave electric field to lie in the gas-activating section 9a of a gas pipe 9. The gas pipe 9 is formed of the above-mentioned gas-activating section 9a part of which is enclosed in the microwave irradiation furnace 6 to be exposed to a microwave electric field created therein, a raw gas inlet section 9b upwardly extending outside of the microwave irradiation furnace 6 and an activated gas outlet section 9c also downwardly extending outside of said microwave irradiation furnace 6. The gas-activating section 9a is made of highly heat-resistant dielectric material such as quartz. This gas-activating section 9a lies at a point of maximum intensity of a microwave electric field created in the microwave irradiation furnace 6, namely, penetrates the central portion of the metal tube 8 and a magnetic field produced in said microwave irradiation furnace 6. Further, the gas-activating section 9a is spaced from the short plunger 7 toward the entrance of the microwave irradiation furnace 6 by an extent of substantially $\frac{1}{4}(2n-1)$ of a microwave ($n=1,2,3$). The gas-activating section 9a of the gas pipe 9 is made longer than the metal tube 8 outward projecting from the upper and lower holes of the microwave irradiation furnace 6, through which the gas pipe 9 passes, namely, extends between the ceiling of an upper bath 20 concurrently acting to absorb outward leaking microwaves and to cool the microwave irradiation furnace 6, and the bottom wall of a lower bath 21 having the same function. Both baths 20, 21 are mounted on the upper and lower ends of the metal tube 8 respectively so as to surround the gas-activating section 9a of the gas pipe 9 in liquid-tightness. The upper bath 20 is set on the raw gas inlet side of the gas-activating section 9a and the lower bath 21 is disposed on the activated gas outlet side of said gas-activating section 9a. As seen from FIG. 4, conductive covers 22, 23 completely surround the upper and lower baths 20, 21 respectively. The depth of the bath is made larger than that depth of the bath contents (for example, water) at which the intensity of the electric energy of irradiated microwaves falls to half the original level (hereinafter referred to as "the microwave half attenuation depth of water"). With microwaves having a frequency of, for example, 2450 MHz, in case of water the microwave half attenuation depth is about 1 cm. The water flows in the direction of the arrow shown in FIG. 2 from the lower tank 21 disposed on the activated gas outlet side of the gas-activating section 9a to the upper tank 20 positioned on the raw gas inlet side of the gas-activating section 9a.

With the foregoing embodiment, water was used to absorb microwaves. However, the microwave absorber need not be limited to water, but may be formed of any other solid material, for example, ceramics impregnated with carbon powder, provided said material can effectively absorb microwaves. Further, if forcefully cooled, such microwave absorber displays much higher efficiency. The upper and lower ends of the gas-activating section 9a of the gas pipe 9 are respectively connected to the raw gas inlet section 9b and activated gas outlet section 9c both made of stainless steel through O-ring couplers 24, 25 prepared from silicone rubber or fluorine-base resin. The outer end of the raw gas inlet section 9b of the gas pipe 9 is connected through the valve 11 to a raw gas tank 12 holding, for example, oxygen, hydrogen, nitrogen, argon, freon or chlorine, or a mixture thereof. The activated gas outlet section 9c of the gas pipe 9 is connected to the reaction chamber 13 built of stainless steel. Raw gas activated by the above-mentioned microwave energy in the gas-activated section 9a passes through a plurality of fine holes 26 constituting the inlet of the reaction chamber 13 which are provided to effect a uniform gas flow into the reaction chamber 13. The activated gas is ejected on an object material 28 placed on a perforated board 27. The vacuum pump 14 is used to evacuate the gas pipe 9 and reaction chamber 13 to an extent of about $10^{-2}$ to 10 Torr. The vacuum pump 14 is connected to an exhaust pipe 30 provided with a fine hole 29 and positioned below the reaction chamber 13.

As mentioned above, the activated gas generator of this invention comprises the gas-activating section 9a made of dielectric material and extending outside of the metal tube 8 provided to prevent the leakage of microwaves and upper and lower baths (for example, water tanks) disposed at both ends of the metal tube 8 so as to surround the dielectric gas-activating section 9a. The above-mentioned arrangement effectively prevents microwaves from leaking out of the microwave irradiation furnace 6.

Figure 3:
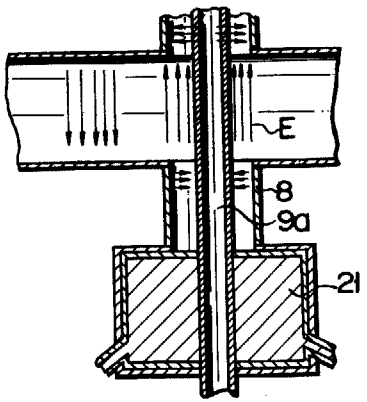
FIG. 3 illustrates the manner in which a magnetic field is made to act in the activated gas generator.

While a raw gas is exposed, as shown in FIG. 3, to the discharge of microwave energy, the water (indicated by hatching in FIG. 3) effectively absorbs as a high frequency wave load the microwaves of an electric field indicated by arrow E appearing between the coaxially arranged gas-activating section 9a and metal tube 8. Further, the water tanks 21, 22 whose depth is made larger than the microwave half attenuation depth completely suppress the leakage of microwaves along the gas-activating section 9a.

With the activated gas generator of this invention, the metal tube 8 for preventing the leakage of microwaves does not project long out of the microwave irradiation furnace 6 as is the case with the prior art activated gas generator. Since the leakage of microwaves can be effectively prevented even though the metal tube 8 is appreciably shortened, the activated gas generator of this invention can have its entire gas passage considerably shortened and consequently be made sufficiently compact for practical application. For example, where (0.8 KW) microwave energy 10.8 KW having a frequency of 2450 MHz is applied, the metal tube for preventing the leakage of microwave energy is fully allowed to be made shorter than half that of the similar metal tube of the prior art activated gas generator shown in FIG. 1, that is, shorter than 10 cm.

The aforesaid water tanks 20, 21 concurrently cool the highly heated gas-activating section 9a of the gas pipe 9. These water tanks 20, 21 prevent the highly elevated heat of the gas-activating section 9a from being transmitted to the raw gas inlet section 9b and the activated gas outlet section 9c connected to said gas-activating section 9a. Therefore, it is preferred that these gas pipe sections 9a, 9b, 9c be separably arranged. The reason is that only the gas-activating section 9a is highly heated, whereas the raw gas inlet section 9b and activated gas outlet section 9c are cooled and little subject to thermal deterioration. Consequently, replacement has only to be made of the gas-activating section 9a when excessively eroded by high heat and the action of a gas plasma, eliminating the necessity of replaceing the raw gas inlet section 9b and activated gas outlet section 9c. Therefore, the activated gas generator of this invention saves much cost and affords high practicability. Further advantage of the present activated gas generator is that since propagation of heat from the gas-activating section 9a is prevented by the water tanks 20, 21, the O-ring couplers 24, 25 need not be made of heat-resistant material.

Figure 4:
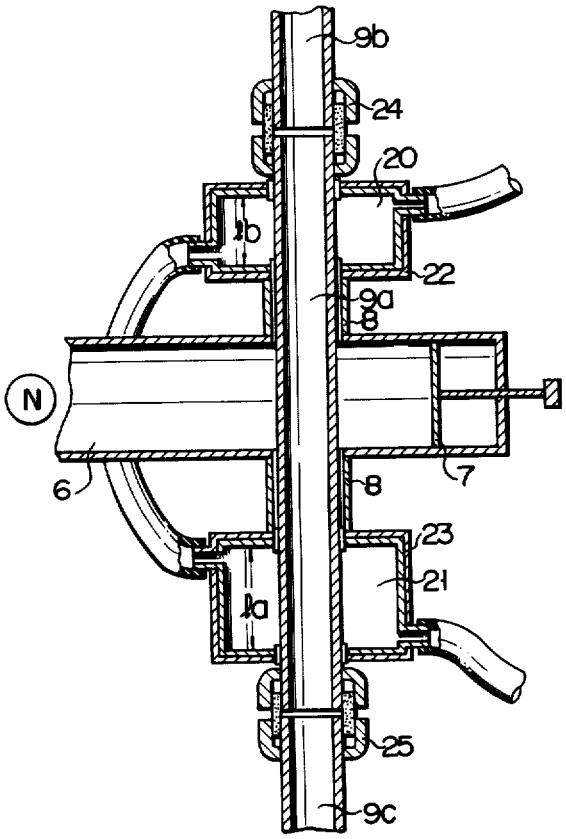
FIG. 4 is an enlarged longitudinal sectional view of the main section of an activated gas generator according to a second embodiment of the invention.

There will now be described by reference to FIG. 4 an activated gas generator according to a second embodiment of this invention. The second embodiment differs from the first embodiment in that the depth la of the lower water tank 21 provided on the activated gas outlet side of the gas-activating section 9a is made larger than the depth lb of the upper water tank 20 positioned on the raw gas inlet side of said gas-activating section 9a. The reason is that since, at the activated gas outlet, the gas-activating section 9a extends long due to the provision of the vacuum pump 14, it is necessary to absorb a larger amount of microwaves leaking along the gas-activating section 9a. The deeper water tank 21 can effectively suppress the leakage of microwaves along said gas-activating section 9a.

Figure 5:
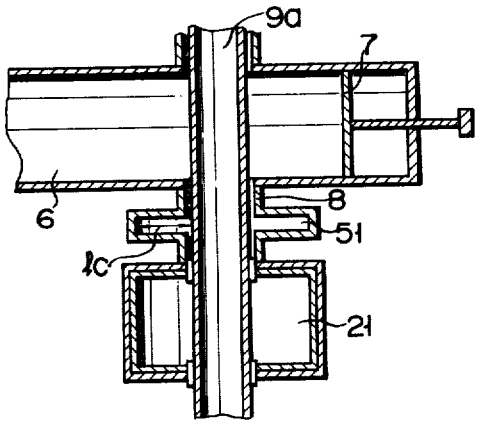
FIGS. 5 to 7 are enlarged longitudinal sectional views of the main sections of activated gas generators modified from the second embodiment.

There will now be described by reference to FIGS. 5 to 7 various modifications of the second embodiment. Referring to FIG. 5, a choke 51 is mounted on the metal tube 8 between the microwave irradiation furnace 6 and the lower water tank 21 set on the activated gas outlet side of the gas-activating section 9a. The choke 51 has a depth lc equal to about one-fourth of the wave length λ of microwave. The provision of the choke 51 fully suppresses the leakage of microwaves from between the gas-activating section 9a and metal tube 8. Therefore, the metal tube 8 and in consequence the entire activated gas passage can be further shortened.

Figure 6:
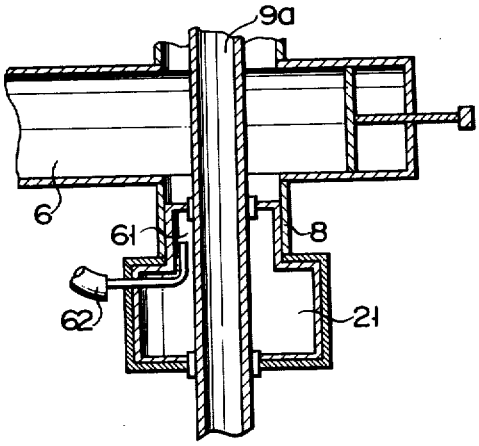

Now referring to the modification of FIG. 6, the lower water tank 21 located on the activated gas outlet side of the gas-activating section 9a has an integrally formed projection 61 extending up to the proximity of the bottom wall of the microwave irradiation furnace 6 through a space defined between the metal tube 8 and gas-activating section 9a. Water is introduced into the projection 61 through a hose 62. Since cooling water is conducted to the proximity of the bottom wall of the microwave irradiation furnace 6 by means of the projection 61, it is possible more effectively to prevent the leakage of microwaves along the gas-activating section 9a and also cool it.

Figure 7:
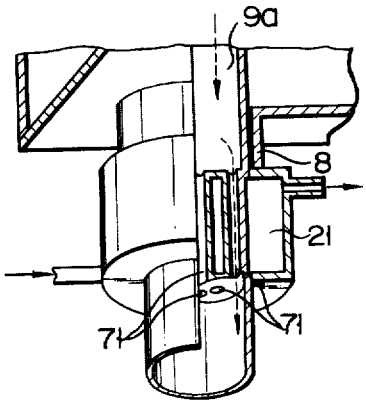

Referring to the modification of FIG. 7, a vertically extending a plurality of pipe 71 is located in the portion of the dielectric tube of gas outlet side of the gas-activating section 9a. Therefore, the leakage of microwaves from the activated gas outlet of the gas-activating section 9a is more effectively suppressed.

Figure 8:
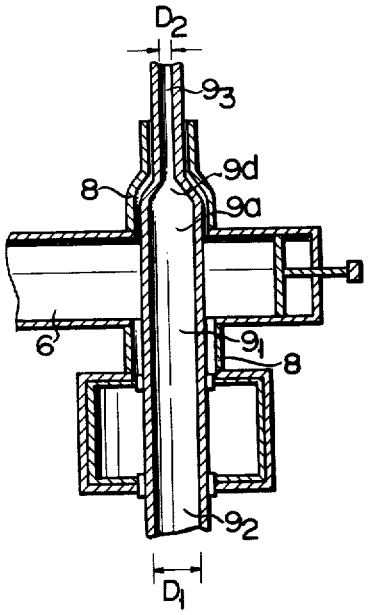
FIG. 8 is an enlarged longitudinal sectional view of the main section of an activated gas generator according to a third embodiment of the invention.

There will now be described by reference to FIG. 8 an activated gas generator according to a third embodiment of this invention. FIG. 8 illustrates only the main section of said third embodiment. The third embodiment differs from the first embodiment of FIG. 2 in that that portion $9_1$ of the gas-activating section 9a which is enclosed in the microwave irradiation furnace 6 and that portion $9_2$ of the gas-activating section 9a which is positioned on the activated gas outlet side have a larger inner diameter $D_1$ than the inner diameter $D_2$ of the raw gas inlet section $9_3$. For example, where microwave having a frequency of 2450 MHz are applied, the inner diameter $D_1$ is set at 38 mm. In contrast, the inner diameter $D_2$ is set at about 8 mm, because a raw gas can be conducted through the raw gas inlet section $9_3$ at any high speed without difficulties. The junction 9d between the narrow section $9_3$ of the smaller diameter $D_2$ and the broader sections $9_1$, $9_2$ of the larger diameter $D_1$ is located near the microwave irradiation furnace 6. Accordingly, the metal tube 8 is tapered along the narrow section $9_3$. Generally, the narrower, the metal tube 8 is, the less noticeable the leakage of microwaves therefrom. Consequently, the tapered metal tube 8 prevents microwaves from leaking through the raw gas inlet section $9_3$. The third embodiment of FIG. 8 suppresses the leakage of microwaves due to the metal tube being tapered, thereby making it unnecessary to provide any extra microwave absorber, but may be provided on the side of junction 9d. Since, with the third embodiment of FIG. 8, the gas-activating section 9a does not extend long toward the raw gas inlet, the activated gas generator of FIG. 8 can have its construction simplified and be rendered more adapted for practical application.

Figure 9:
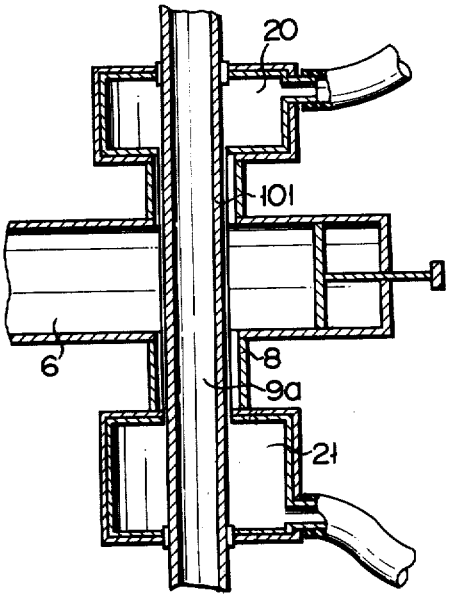
FIGS. 9 to 11 are enlarged longitudinal sectional views of the main sections of activated gas generators according to a fourth to a sixth embodiments.

There will now be described by reference to FIG. 9 an activated gas generator according to a fourth embodiment. FIG. 9 only shows the main section of the fourth embodiment. A water pipe 101 surrounds that portion of the gas-activating section 9a which passes through the microwave irradiation furnace 6. The upper end of the water pipe 101 is connected to the upper water tank 20 disposed at that end of the gas-activating section 9a which is connected to the raw gas inlet section 9b. The lower end of the water pipe 101 is connected to the lower water tank 21 positioned at the activated gas outlet of the gas-activating section 9a. The water of the lower tank 21 is conducted through the water pipe 101 to the upper water tank 20. An interstice between the inner wall of the water pipe 101 and the outer wall of the gas-activating section 9a is made as narrow as possible, insofar as the microwave electric energy conducted through the irradiation furnace 6 is not obstructed in activating raw gas supplied from a source. The interstice is made narrower than, for example, a fraction of the length of microwaves applied. The water pipe 101 provided along that portion of the gas-activating section 9a from which microwaves tend to leak completely suppresses said leakage. This arrangement enables a gas passage to be more shortened and renders an activated gas generator more compact.

Figure 10:
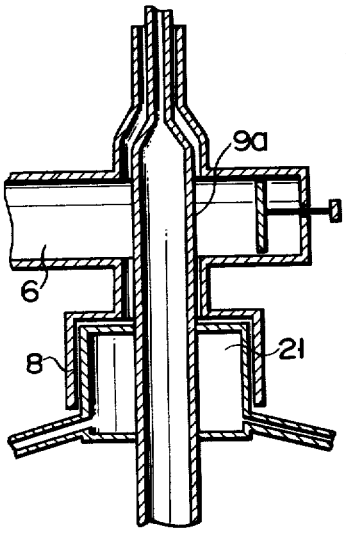

There will now be described by reference to FIG. 10 an activated gas generator according to a fifth embodiment of the invention. FIG. 10 shows a modification of the third embodiment of FIG. 8, with only the main section indicated.

The lower water tank 21 disposed on the activated gas outlet side of the gas-activating section 9a constitutes an integral part of said gas-activating section 9a. The metal tube 8 surrounds the water tank 21. Since, with the fifth embodiment of FIG. 10, the water tank 21 alone is provided on the activated gas outlet side of the gas-activating section 9a, said section 9a, together with the water tank 21, can be inserted into the microwave irradiation furnace 6 from below. The fifth embodiment of FIG. 10 which makes it unnecessary to provide, for example, packing between the gas-activating section 9a and water tank 21 enables an activated gas generator to have a simpler construction and in consequence be rendered more adapted for practical application.

Figure 11:
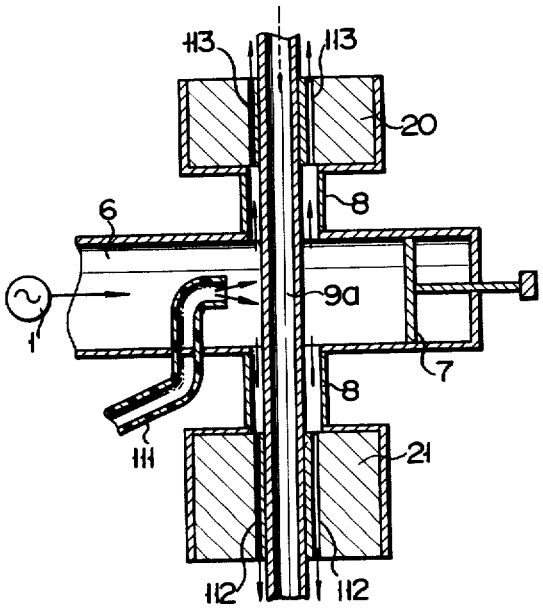

There will now be described by reference to FIG. 11 an activated gas generator according to a sixth embodiment of this invention. According to this embodiment, solid cylindrical microwave absorbers 20, 21 are set on both sides of the microwave irradiation furnace 6. Cooling air is brought into said furnace 6 through a hose 111 made of dielectric material. The cooling air is ejected on to the outer surface of the gas-activating section 9a. Both cylindrical microwave absorbers 20, 21 are bored with a plurality of ventilators 112, 113 which extend lengthwise of the microwave absorbers 20, 21 and are arranged in the circular form. Accordingly, cooling air flows along the peripheral wall of the gas-activating section 9a in the direction of the indicated arrows and is drawn out through the ventilators of the microwave absorbers 20, 21. Accordingly, not only the gas-activating section 9a but also the microwave absorbers 20, 21 are effectively cooled and prevented from being overheated. The embodiment of FIG. 11 which does not use a liquid admits of easy assembly and handling.

As mentioned above, the activated gas generator of this invention affords prominent economic and practical advantages that the leakage of microwaves along a gas pipe is reliably suppressed, making it possible to use a much shorter gas pipe than in the prior art activated gas generator; where a liquid microwave absorber is concurrently used as a cooling agent, the highly heated gas-activating section of the gas pipe is thermally shut off from the adjacent other gas pipe sections; these other gas pipe sections which are always cooled are little subject to deformation and dispense with replacement, only requiring the highly heated gas-activating section of the gas pipe to be changed when excessively eroded by heat and gas plasma.

What is claimed is:

1. In an activated gas generator including a microwave electric energy generator, a microwave irradiation furnace for receiving microwave energy delivered from said microwave electric energy generator, a gas pipe including a central portion which extends through the microwave irradiation furnace, one end of the pipe being connectable to a source of raw gas and the other end of said pipe being connectable to first a reaction chamber followed by evacuation means and a metal tube extending outside of the microwave irradiation furnace and coaxially surrounding the dielectric tube, the improvement comprising a dielectric tube for activating raw gas from said source, formed in said central portion of said pipe and extending from a portion of said tube inside said furnace toward said other end of said pipe to another portion of said tube outside said furnace and means, including said metal tube mounted to at least said another portion of said tube, for absorbing said microwave energy and cooling said dielectric tube.

2. The activated gas generator according to claim 1, wherein the microwave-absorbing and dielectric tube cooling means includes a microwave absorbing material including water.

3. The activated gas generator according to claim 1 wherein the microwave-absorbing means is formed of ceramics impregnated with carbon powder.

4. The activated gas generator according to claim 2 or claim 3, wherein the microwave-absorbing means comprises upper and lower containers for said microwave absorbing material positioned on the raw gas inlet side and activated gas outlet side of the dielectric tube respectively and a pipe stretched between both containers to surround the dielectric tube.

5. The activated gas generator according to claim 2 or claim 3, wherein the microwave-absorbing means consists of that portion of the dielectric tube which is disposed on the raw gas inlet side and has a smaller inner diameter than that portion of said dielectric tube which is positioned on the activated gas outlet side, and a container for said microwave absorbing material provided on said activated gas outlet side.

6. The activated gas generator according to claim 5, wherein the bath positioned on the activated gas outlet side of the gas pipe is integrally formed with the dielectric tube.

7. The activated gas generator according to claim 2 or claim 3, which further comprises a hose made of dielectric material and received in the microwave irradiation furnace, through which cooling air is ejected on to the dielectric tube; and a plurality of ventilators penetrating the microwave-absorbing means along the dielectric tube enclosed in said means.

8. The activated gas generator according to claim 2, wherein the microwave-absorbing and dielectric tube cooling means further comprises at least one container for said microwave absorbing material mounted at one end of the metal tube to enclose the dielectric tube, to thereby concurrently suppress the leakage of microwaves along the dielectric tube and also cool said dielectric tube.

9. The activated gas generator according to claim 8, wherein the microwave-absorbing means comprises another container for said microwave absorbing material positioned on the activated gas outlet side of said dielectric tube concurrently to suppress the leakage of microwaves along the dielectric material and also cool it.

10. The activated gas generator according to claim 9, wherein said another container has a larger depth than the container which is provided on the raw gas inlet side of the dielectric tube.

11. The activated gas generator according to claim 9, wherein a choke is provided between the microwave irradiation furnace and said another container disposed on the activated gas outlet side of the dielectric tube.

12. The activated gas generator according to claim 11, wherein the choke has a depth equal to about one-fourth of the wave length of microwave used.

13. The activated gas generator according to claim 9, wherein said another container is provided with a projection which extends upward through a space defined between the outer wall of the dielectric tube and the inner wall of the metal tube to the proximity of the bottom of the microwave irradiation furnace.

14. The activated gas generator according to claim 9, wherein that portion of the dielectric tube which is located on the activated gas outlet side contains a plurality of vertically-set fine tubes, both ends of which communicate with the corresponding parts bored in the inner wall of the surrounding container.

15. The activated gas generator according to claim 1, wherein the dielectric section of the gas pipe is formed of a different material from the other adjacent sections of said gas pipe.

* * * * *